US005173995A

United States Patent [19]

Pezzoli et al.

[11] Patent Number: 5,173,995

[45] Date of Patent: Dec. 29, 1992

[54] PROCESS AND DEVICE FOR FEEDING A MATERIAL IN FIBRE FORM IN A MACHINE FOR PREPARING SAID MATERIAL FOR THE SUBSEQUENT SPINNING, IN PARTICULAR AN OPENER

[75] Inventors: Luigi Pezzoli, Villa di Serio; Emilio Vezzoli, Castelli Calepio, both of Italy

[73] Assignee: Fratelli Marzoli & C. S.p.A., Italy

[21] Appl. No.: 630,584

[22] Filed: Dec. 20, 1990

[30] Foreign Application Priority Data

Dec. 21, 1989 [IT] Italy ..... 22780 A/89

[51] Int. Cl.[5] ..... D01G 15/40

[52] U.S. Cl. ..... 19/105; 19/0.21; 19/204

[58] Field of Search ..... 19/0.21, 105, 200, 202, 19/203, 204, 205, 98, 99

[56] References Cited

U.S. PATENT DOCUMENTS

| | | | |
|---|---|---|---|
| 2,755,512 | 7/1956 | Moss | 19/202 |
| 4,001,916 | 1/1977 | Grimshaw | 19/105 |
| 4,035,871 | 7/1977 | Stahlecker | 19/200 |
| 4,100,650 | 7/1978 | Wirth et al. | 19/105 |
| 4,167,803 | 9/1979 | Teichmann | 19/105 |
| 4,222,154 | 9/1980 | Staheli et al. | 19/105 |
| 4,506,413 | 3/1985 | Leifeld | 19/105 |
| 4,858,277 | 8/1989 | Pinto et al. | 19/105 |

FOREIGN PATENT DOCUMENTS

| | | | |
|---|---|---|---|
| 0285602 | 3/1988 | European Pat. Off. . | |
| 1952829 | 4/1970 | Fed. Rep. of Germany . | |
| 3534933 | 4/1987 | Fed. Rep. of Germany . | |
| 3608514 | 9/1987 | Fed. Rep. of Germany | 19/105 |
| 2067608 | 7/1981 | United Kingdom . | |
| 2198461 | 6/1988 | United Kingdom | 19/105 |

*Primary Examiner*—Werner H. Schroeder
*Assistant Examiner*—Michael A. Neas
*Attorney, Agent, or Firm*—Diller, Ramik & Wight

[57] ABSTRACT

A process of and a feeding device for feeding material in fibre form to a machine for preparing the material for subsequent spinning includes a material feeding bin through which the material is continuously fed to a substantially horizontal feeding table situated approximate a rotary preparing roll. The horizontal feeding table and the approximate rotary preparing roll define an air gap therebetween. A feeder roll is located above the feeding table which conveys the material toward the air gap, and the feeding table is supported to move in a substantially radial direction relative to the rotary preparing roll under the influence of data detected by a detecting device which detects the impurity level of the material at a point upstream of the feeding table relative to the direction of fibre flow.

15 Claims, 3 Drawing Sheets

PROCESS AND DEVICE FOR FEEDING A MATERIAL IN FIBRE FORM IN A MACHINE FOR PREPARING SAID MATERIAL FOR THE SUBSEQUENT SPINNING, IN PARTICULAR AN OPENER

The present invention relates to a process and a device for feeding a material in fibre form in a machine for preparing said material for a subsequent spinning, in particular an opener or a card.

For feeding material in fibre form, such as flocks of cotton staples, to a machine for preparing said materials for subsequent spinning, devices are known in the art which are provided with a feeding bin through which the material is continuously fed to a substantially horizontal feeding table positioned at a small distance from a rotary preparing roll, in particular an opener roll. A feeder roll is provided above the feeding table which conveys a material towards the air gap between the end of the feeding table and the preparing rotary roll.

The material which in case of an opener roll is opened and cleaned by the action performed by the cooperation of the roll with the end of the feeding table and with blade grids installed downstream the feeding table, is then collected and conveyed to downstream machines, such as cards.

According to the characteristics of the material fed to the preparing machine, in particular according to the length of the flock staples, in order to achieve an efficacious treatment of said fibres, it is known in the art to provide a mechanism to adjust the position of the feeding table so as to be able to vary the air gap between the feeding table and the preparing roll. The operation of the position adjustment mechanism is carried out at the beginning of the processing by the operator who, by knowing the average characteristics of the material to be processed, fastens the feeding table in the proper position, namely, increasing the length of the air gap in case of longer fibres, in order to prevent said fibres from being torn or damaged during the nipping action they undergo at said air gap, or decreasing the length of this air gap in case of shorter fibres in order to prevent them from being discarded together with the impurities contained in the material.

This adjustment of the position of the feeding table improves the quality of the prepared material which leaves the machine, but limits the removal of the impurities, in particular if the impurity level of the fed material varies as the material is fed. In fact, it may happen that the initial adjustment made on the basis of the average length of the fibres in order to open them without causing damages to them, and without suffering any fibre losses, are inadequate for the substantial removal of the impurities of different characteristics and different amounts. The result is that it may happen that the quality of the product which leaves the preparing machine is unsatisfactory as regards its impurity level.

The main purpose of the present invention is that of providing a process and a device for feeding material in fibre form in a machine for preparing said material for subsequent spinning, in particular an opener or a card, which make possible a high level of cleanliness of the material leaving the machine, and consequently the quality of the material prepared for the subsequent processing steps, is improved.

This purpose is achieved according to the present invention by means of a process by which, during the feeding of the material, the level of impurity of the material is detected, preferably continuously or at short time intervals, and on the basis of the detected data the position of the feeding table relatively to the preparing roll is varied, preferably continuously or at short time intervals.

In order to practice the process, a feeding device is characterized by the feeding table being supported for movements in a substantially radial direction relative to the preparing roll, and means for positioning the feeding table are provided, which are driven as a function of the data detected by a device for measuring the impurity level of the material which is installed upstream said feeding table.

In this way, the position of the feeding table is constantly controlled so that the distance between its end and the preparing roll is adjusted from time to time, during the processing, on the basis of the amount and of the quality of the impurities contained in the fed material, and not as a function of the average length of the fibres. In this way, the quality of the material which leaves the machine can be considerably improved because the cleaning is carried out by continuously taking into consideration the actual level of impurity of the material which is fed to the table, and consequently adjusting, optionally automatically, the distance of the table from the opener roll in order to achieve the best conditions of opening of the material and of the removal of the impurities, with allowance being made for the length of the fibres.

In the past, detecting the level of impurity for the material fed to an opener roll by continuously monitoring the presence of impurities in the material flowing through the feeding bin was proposed, but the detected data was used in order to vary the actuation of the opener roll and of the feeder rolls, not the length of the nipping air gap. However, varying the speed of the opener roll involves the risk of damaging the fibres particularly in order to improve the opening for the purposes of a more efficacious removal of the impurities when the speed of the roll opener is increased, with the fibres being thus submitted to violent opening action.

On the contrary, acting on the nipping air gap according to the present invention makes possible a better opening without the fibres undergoing high stress because the fibres are dragged to move always at the same speed by the opener roll through a purposely adjusted passage.

With the above and other objects in view that will hereinafter appear, the nature of the invention will be more clearly understood by reference to the following detailed description, the appended claims and the several views illustrated in the accompanying drawings.

Figure 1:
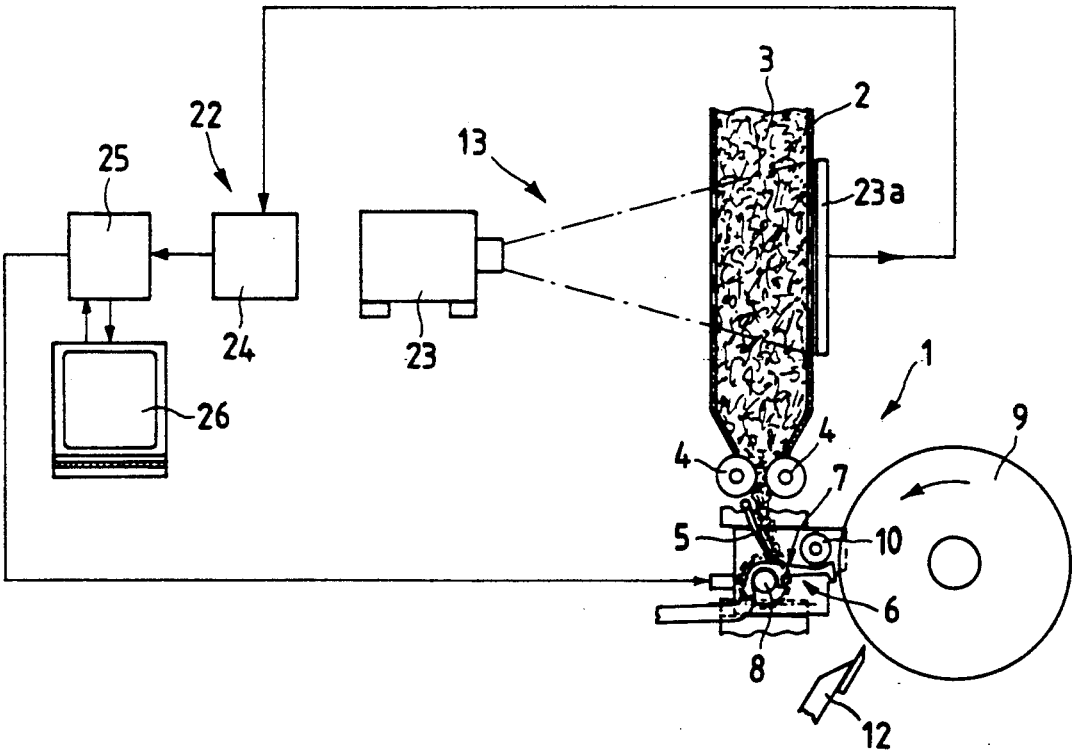
FIG. 1 is a schematic side elevation view of a feeding device according to the present invention, applied to an opener.
Figure 2:
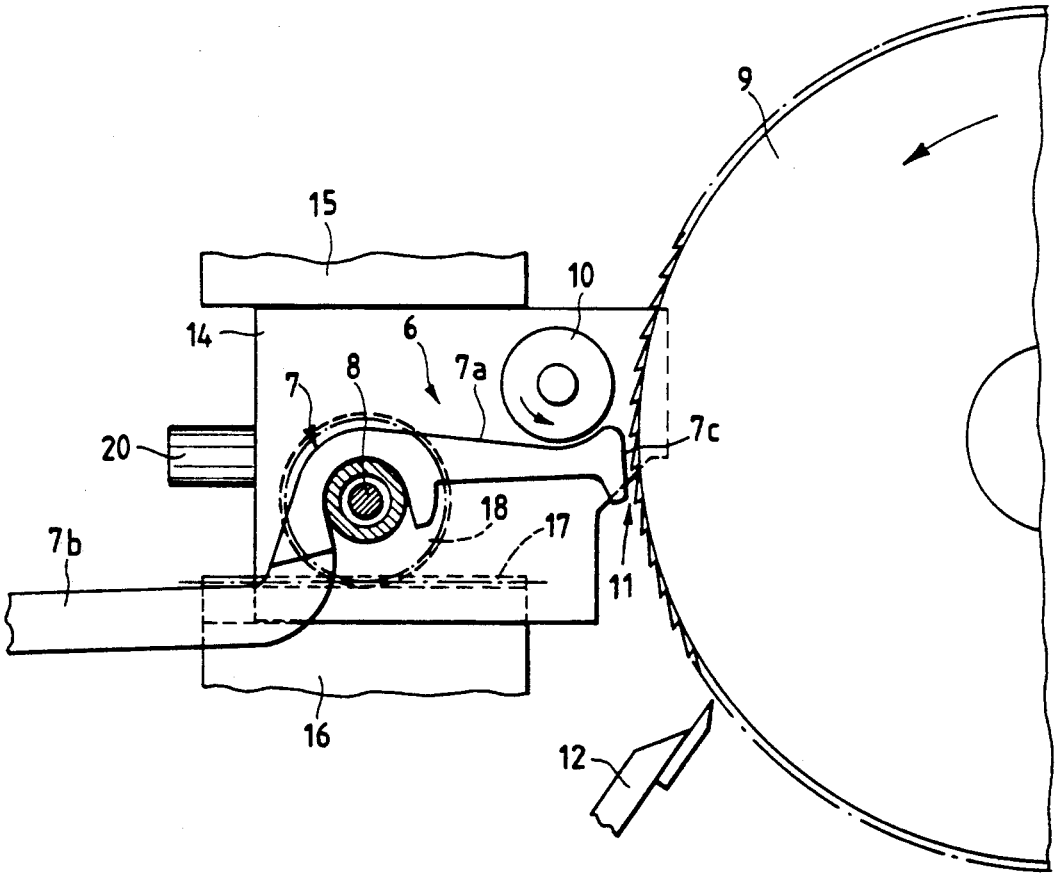
FIG. 2 is an enlarged view of a portion of the device of FIG. 1.
Figure 3:
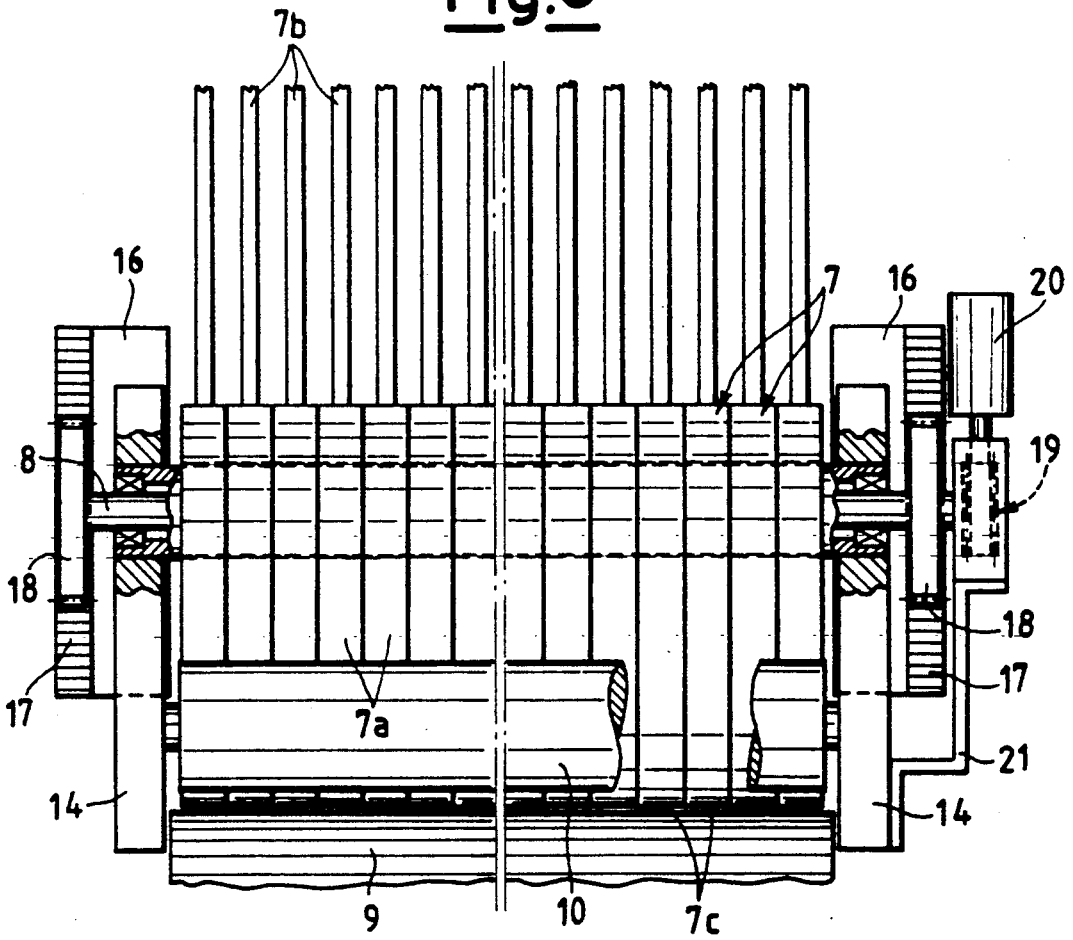
FIG. 3 is a partially cross-sectional top view of a portion of the device of the preceding figures.
Figure 4:
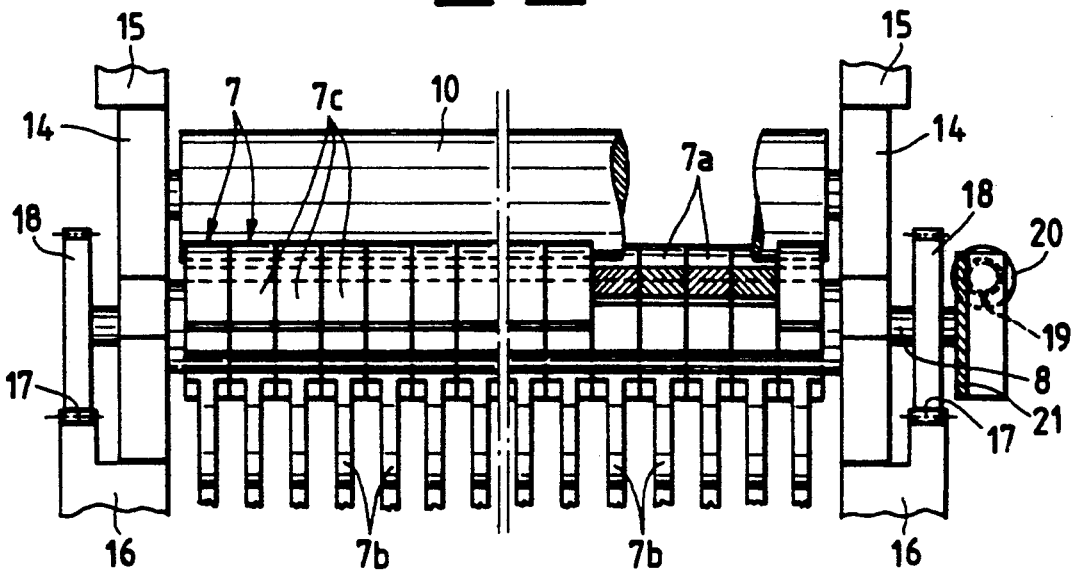
FIG. 4 is a partially cross-sectional front elevation view of the device of FIG. 3.

Referring to the drawings, a feeding device according to the instant invention, applied to an opener 1, comprises a feeding bin 2 from which material in form of flocks of staples 3 is fed by two motor-driven feeder rolls 4. The material is fed by the rolls 4 from the bin 2 to a guide 5 situated above a feeding table 6.

The table 6 includes arms *7a* of a plurality of swinging levers 7 positioned alongside each other, and hinged around a common shaft 8 perpendicular to the length of the levers 7. The levers 7 are independent from one another and each of them has, besides the arm *7a* directed towards the peripheral surface (unnumbered) of a suitably lined opener roll 9, an opposite arm *7b*, only partially visible in the drawing, capable of cooperating in a known way with a respective microswitch in case the angle of any one of swinging of the levers 7 exceeds a preset value owing to the effect of coarse impurities in the material fed to the opener roll 9. A spring (not shown) biases each lever 7 to a position close to a feeder roll 10 installed above the arm *7a* of the levers 7.

When the device operates there is a gap between the roll 10 and the levers 7 which allows the material in fibre form which is fed by the rotary movement of the roll 10, to flow. The material then enters an air gap 11 between ends *7c* of the arms *7a* of the levers 7 and the opener roll 9 to effect a nipping action which causes the opening of the fibres and the removal of the therein contained impurities. That action can be integrated by conventional blades 12 arranged in a conventional manner. The directions of rotation of the rolls 9 and 10 are shown in the drawing by the unnumbered headed arrows associated therewith.

According to the present invention, for the purpose of optimizing the effect of opening and cleaning of the material and of supplying, at the outlet from the opener 1, a high-quality material destined to be submitted to the subsequent processing steps, the present invention includes apparatus for and a process of varying the relative position of the feeding table 6 relative to the opener roll 9 as a function of the length of the fed fibres and of the degree of impurity of the material.

For that purpose, while the material in fibre form 3 is being fed, the level of impurity of the material is detected, preferably in continuous or at short time intervals, and on the basis of the detected data the position of the feeding table 6 (formed by the arms *7a* of the levers 7) is varied—preferably in continuous or at short time intervals—relatively to the opener roll 9, so as to achieve the optimal treatment conditions.

In fact, the table 6 is supported for shifting in a substantially radial direction relative to the opener roll 9, and positioning means for controlling the position of the table 6 are provided, which are commanded as a function of the data detected by an impurity detector 13 installed upstream the table 6, in particular in correspondence of the path of the material 3 inside the feeding bin 2.

More precisely, in the herein depicted example, the shaft 8 on which the levers 7 are hinged and the feeder roll 10 are rotatably supported by two side shoulders 14 so installed as to be capable of sliding in a substantial horizontal direction and radially relative to the roll 9 between two fixed guides 15 and 16. Each one of the guides 16 has, externally to the shoulders 14, a portion provided with a rack 17, with which a respective gearwheel 18 intermeshes. Each gearwheel 18 is integrally affixed to the shaft 8 which supports the levers 7, so as to be able to rotate together with said shaft. At one end of the shaft 8 a worm-helical gearwheel transmission 19 is provided, which is capable of transmitting to the shaft 8 a rotary movement generated by a servomotor 20 supported, together with a transmission box 19, by a bracket 21.

The servomotor 20 is operatively connected with an electronic control apparatus 22 comprising detector means 13 which detect the impurities contained in the material 3. The means 13 can be constituted by an optical detector, such as a light emitter 23 aimed at the bin 2 so as to take in the whole width of said bin and a portion of the height thereof, in view of which the opposite walls of the bin 2 are made transparent, and a receiver screen 23a installed behind the bin.

The screen 23a, as a function of the amount of light which impinges on it—and which is a function of the amount and of the quality of the impurities contained in the material—sends corresponding signals to an electronic unit 24 which converts them into signals indicative of the level of impurity of the material which at that time runs through the bin 2 in the region thereof monitored by the emitter/receiver detector 23, 23a. The signal generated by the unit 24 is sent to a microprocessor unit 25 which, on the basis of the detected data and of the previously stored data, which supply the optimum distance between the table 6 and the roll 9 as a function of the level of impurity of the material and of the length of the fibres, generates the signals which govern the servomotor 20 in order to cause the latter to adjust the position of the table 6 at the optimum distance. An operator station 26 makes it possible for the data to be displayed, as well as the characteristics data of the material to be stored in the memory of the microprocessor unit 25.

One can realize that a certain delay will occur—depending on the distance of the impurity detection area from the area of nipping in the air gap 11 and on the material feeding speed—between the point in time at which the impurities are detected and the point in time at which the actuation of the servomotor 20 actually takes place. The rotary movement of the latter, by causing the associated gearwheel 18 to rotate—after a previous suitable speed reduction—causes the whole table 6 with the feeder roll 10 to shift along a rectilinear trajectory, with movements of approaching to, or of moving away from, the opener roll 9, as needed. In that way, the distance between the end *7c* of the table 6 and the opener roll 9 is continuously controlled and, whenever necessary, changed, so as to change the intensity of nipping of the material, according to the quality and the amount of the impurities contained in the material, in order to accomplish optimal conditions of opening and cleaning of the material. The movement of the table 6, which movement occurs over a limited stroke, does not have any effect on the contact between the arms *7b* of the lever 7 and the relevant microswitches which each includes a contact slidable in a direction perpendicular to the direction of actuation of the microswitches by the levers 7.

Furthermore, one might also think of controlling the position of the feeding table 6 in such a way that said position only undergoes an adjustment when from the comparison between the detected impurity data and the stored data a difference emerges, which is greater than a preset value.

By means of the process and device according to the present invention, the characteristics of the material can be optimized in the step of preparation of the material for spinning, both so as the length of the fibres, and the amount and the nature of the impurities. Inasmuch as neither the rotational speed of the opener roll 9, nor the rotational speed of the feeder rolls 4 or of the feeder roll 10 are changed, the material does not undergo any alterations in its dragging modulus, but is only subject to a different nipping effect, more suitable for causing the fibres to be opened without being damaged, and with an improved cleaning effect.

Instead of direct automatic control, a manual control of positioning of the table 6 could be provided as well, by manually adjusting the position of said table 6, on the basis of a purposely provided scale, as a function of the data displayed by the electronic detector apparatus 22.

Of course, several other modifications are possible within the scope of the inventive concept. So, e.g., the servomotor 20 could rotate a gearwheel intermeshing with a rack fastened onto a mobile structure supporting the table 6. The table 6 could also be of a type different from the table 6 formed by levers 7, as herein illustrated and described, e.g., it could comprise of one single element fastened to the shoulders 14. The detector means 13 could be constituted by a TV camera connected with the unit 24.

We claim:

1. A process of feeding a material in fibre form to a machine for preparing the material for subsequent spinning comprising the steps of continuously feeding the material to a feeding table and causing the material to flow between the feeding table and a preparing roll, during the feeding of the material the level of impurity of the material is detected, and on the basis of the detected impurity level the position of the feeding table relative to an opening roll is varied.

2. The process as defined in claim 1 wherein the material is submitted to optical monitoring.

3. The process as defined in claim 1 wherein the positioning of the feeding table is performed with a delay relative to the impurity level detection, which delay depends on a distance between an area in which said detection is carried out and an area in which the material is processed and on the speed at which the material is fed.

4. The process as defined in claim 1 wherein the detecting of the level of impurity and the adjustment of feeding table position are carried out continuously.

5. The process as defined in claim 1 wherein the detection of the impurity level and the adjustment of feeding table position are performed at short time intervals.

6. The process as defined in claim 1 wherein the detected impurity level is compared to data stored in a memory and a command of adjustment of the feeding table position is only issued if from said comparison a difference larger than a certain value is evidenced.

7. A feeding device for feeding a material in fibre form to a machine for preparing the material for subsequent spinning comprising a material feeding bin through which material is continuously fed to a substantially horizontal feeding table situated approximate a rotary preparing roll and defining an air gap therebetween, at least one feeder roll above said feeding table for conveying the material towards the air gap, said feeding table being supported to perform movements in a substantially radial direction relative to the rotary preparing roll, and means for positioning and supporting the feeding table which are actuated as a function of data detected by a device detecting the impurity level of the material installed upstream of said feeding table relative to a direction of fibre flow.

8. The feeding device as defined in claim 7 wherein the feeding table is supported by a mobile support structure operatively connected with a servomotor governed by an electronic data processing apparatus which processes the data detected by said detecting device.

9. The feeding device as defined in claim 7 wherein the feeding table is defined by swinging levers positioned along side each other which are independently hinged to a single shaft, and the shaft is supported by a structure capable of moving in a substantially radial direction relative to the preparing roll.

10. The feeding device as defined in claim 9 wherein said shaft is rotatably supported by said structure and bears at least one solidly affixed gear wheel intermeshing with at least one rack solidly affixed to the machine, and said shaft being driven to revolve as a function of data detected by an impurity detecting means.

11. The feeding device as defined in claim 9 wherein said structure is equipped with two side shoulders rotatably supporting said shaft and a feeder roll, and externally to said shoulders are two racks each of which is engaged with a gear wheel solidly affixed to said shaft, and said shoulders being slidable inside fixed guides provided on the machine.

12. The feeding device as defined in claim 9 wherein said shaft is operatively connected with a servomotor actuated by an electronic data processing apparatus which process is data detected by an impurity detecting means.

13. The feeding device as defined in claim 7 wherein said detecting device comprising an optical detector installed in correspondence of said feeding bin.

14. The feeding device as defined in claim 13 wherein the optical detector is constituted by a light-emitter element and a light-receiver element installed in opposite sides of said fibre feeding bin in correspondence of transparent walls of said bin.

15. The feeding device as defined in claim 8 wherein the electronic data processing apparatus comprises a microprocessor unit which stores data relevant to parameters of impurity of the material and to parameters of position of the feeding table and of comparing data detected to the stored data, as well as of generating signals of command of adjustment of the position of the feeding table, depending on the results of said comparison.

* * * * *